US006629680B2

(12) United States Patent
Weck et al.

(10) Patent No.: US 6,629,680 B2
(45) Date of Patent: Oct. 7, 2003

(54) HANGER FOR AND OBJECT ADAPTED TO BE HUNG ON A WALL

(75) Inventors: David Weck, Miami, FL (US); Erwin M. Frey, Ft. Lauderdale, FL (US)

(73) Assignee: Micasa Trading Corporation, Miami, FL (US)

( * ) Notice: Subject to any disclaimer, the term of this patent is extended or adjusted under 35 U.S.C. 154(b) by 0 days.

(21) Appl. No.: 09/985,549

(22) Filed: Nov. 5, 2001

(65) Prior Publication Data

US 2003/0085331 A1 May 8, 2003

(51) Int. Cl.[7] ..... A47F 7/14

(52) U.S. Cl. ..... 248/475.1; 248/300; 248/176.1; 40/757

(58) Field of Search ..... 248/300, 205.3, 248/466, 467, 216.1, 216.4, 217.3, 176.1, 475.1, 476, 683, 684, 687, 692, 493, 205.4

(56) References Cited

U.S. PATENT DOCUMENTS

| | | | | | |
|---|---|---|---|---|---|
| 201,695 | A | | 3/1878 | Merrill | |
| 242,913 | A | * | 6/1881 | Franklin | 248/547 |
| 267,459 | A | * | 11/1882 | Riley | 248/547 |
| D28,724 | S | | 5/1898 | Heaton | |
| 674,438 | A | | 5/1901 | Edmundson | |
| 886,241 | A | | 4/1908 | Norton | |
| 28,289 | A | * | 12/1909 | Larsson | 248/547 |
| 992,203 | A | | 5/1911 | Johnson | |
| D42,970 | S | | 9/1912 | Larsson | |
| 1,161,268 | A | | 11/1915 | Tuck | |
| 1,560,029 | A | * | 11/1925 | Erickson | 248/217 |
| 1,637,981 | A | * | 8/1927 | Baldwin | 248/29 |
| D105,897 | S | | 8/1937 | Rubel | |
| 2,317,368 | A | | 4/1943 | Frey | |
| 2,330,373 | A | * | 9/1943 | Moore | 248/547 |
| 2,334,700 | A | * | 11/1943 | Frey | 248/32 |
| 2,454,813 | A | | 11/1948 | Larson | |
| 2,496,990 | A | * | 2/1950 | Downing | 248/217 |
| D196,300 | S | | 9/1963 | Isensee, Jr. | |
| D199,841 | S | | 12/1964 | Margulis | |
| 3,216,680 | A | | 11/1965 | Musante | |
| 3,235,218 | A | * | 2/1966 | Graham | 248/547 |
| 3,298,651 | A | * | 1/1967 | Passer | 248/29 |
| 3,337,926 | A | | 8/1967 | Daugherty | |
| 3,912,211 | A | | 10/1975 | Topf | |
| 3,913,876 | A | * | 10/1975 | McSherry | 248/74 |
| 3,974,557 | A | | 8/1976 | Einhorn | |
| 4,026,510 | A | | 5/1977 | Holmes | |
| D247,219 | S | | 2/1978 | Yensh | |
| D247,220 | S | | 2/1978 | Yensh | |
| 4,083,525 | A | * | 4/1978 | Rath | 248/496 |
| 4,094,490 | A | | 6/1978 | Einhorn | |
| 4,124,189 | A | | 11/1978 | Einhorn | |
| 4,422,608 | A | | 12/1983 | Hogg | |
| 4,485,995 | A | | 12/1984 | Hogg | |
| D281,144 | S | | 10/1985 | Astolfi | |
| 4,619,430 | A | | 10/1986 | Hogg | |
| 4,669,169 | A | | 6/1987 | Hogg | |
| 4,708,552 | A | | 11/1987 | Bustos et al. | |
| D296,759 | S | | 7/1988 | Greenhut et al. | |
| D299,003 | S | | 12/1988 | Fadeley, Jr. | |
| D305,431 | S | | 1/1990 | Adams | |
| 4,962,907 | A | * | 10/1990 | Gary | 248/205.3 |
| 5,069,412 | A | | 12/1991 | Jacob | |
| 5,267,719 | A | | 12/1993 | Keller | |
| D344,010 | S | | 2/1994 | Brazis | |
| 5,328,140 | A | | 7/1994 | Wong | |
| 5,542,641 | A | | 8/1996 | Donovan | |
| 5,749,558 | A | | 5/1998 | Wallo | |
| 5,803,425 | A | | 9/1998 | McCoy, II | |
| 6,042,078 | A | | 3/2000 | Donovan | |
| D422,892 | S | | 4/2000 | Donovan | |
| 6,206,334 | B1 | * | 3/2001 | Weck et al. | 248/467 |
| 6,224,030 | B1 | | 5/2001 | Hepworth | |

FOREIGN PATENT DOCUMENTS

| | | |
|---|---|---|
| DE | 803667 C | 4/1951 |
| FR | 666154 A | 9/1929 |
| FR | 2731893 | 9/1996 |
| GB | 858071 | 1/1961 |

* cited by examiner

*Primary Examiner*—Kimberly Wood
(74) *Attorney, Agent, or Firm*—Lowe Hauptman Gilman & Berner, LLP

(57) ABSTRACT

A picture hanger has a metal base from which is stamped a tongue for receiving a wire of a picture frame hung on a wall. The tongue has a convex shape with respect to a front face of the base and a ledge thereof on which the wire rests bears against a protrusion extending from the base front face. The tongue has bends with progressively increasing angles as it extends away from the base.

30 Claims, 3 Drawing Sheets

HANGER FOR AND OBJECT ADAPTED TO BE HUNG ON A WALL

FIELD OF INVENTION

The present invention relates generally to hangers for hanging objects on walls and, more particularly, to a wall hanger including a tongue having a convex shape with respect to a base from which the tongue extends. Another aspect of the invention relates to a hanger including a protrusion extending beyond a front face of the base beneath a tongue, wherein an upper portion of the protrusion is substantially at an intersection of the base and tongue so an end of the tongue at the intersection bears on an upper portion of the protrusion.

BACKGROUND ART

Numerous structures have been developed for hanging objects, such as picture frames, on walls. However, the typical prior art structures frequently damage walls to which they are attached and in some instances damage the hung object. Many of the prior art structures have relatively complex shapes, with numerous bends having a tendency to cause relatively high manufacturing costs. In addition, the bends are frequently of such a nature that the structure is weakened to reduce the carrying capacity thereof. Also, many of the prior art structures can cause fraying of wires or other thin elongated structures attached to the object being hung on the wall.

It is, accordingly, an object of the present invention to provide a new and improved hanger for objects to be hung on a wall.

Another object of the invention is to provide a new and improved hanger for objects to be hung on a wall, wherein the structure is relatively inexpensive and is constructed in a manner so that wall damage and damage to the object being hung are minimized.

A further object of the invention is to provide a new and improved hanger for an object to be hung on a wall, wherein the hanger has a shape enabling it to be easily and inexpensively made, for example, by stamping, and wherein bends of the stamped structure are such that the structure has relatively high structural strength and can hold very substantial loads.

A further object of the invention is to provide a new and improved hanger for objects to be hung on a wall, wherein the hanger is arranged so that elongated structures on the hung object are easily inserted onto the hanger and the tendency for fraying of the elongated structure, such as a wire, is substantially minimized.

SUMMARY OF THE INVENTION

According to one aspect of the invention, a hanger for an object adapted to be hung on a wall comprises a base to be fixedly attached to the wall and a tongue extending from the base so that when the base is attached to the wall, the tongue includes a substantial portion extending in a generally upward direction from a region of the base where an end of the tongue intersects the base. A segment of the tongue in close proximity to the intersection of the tongue end and base is arranged to receive and hold a thin elongated support structure, such as a wire, attached to the object when the base is attached to the wall. The tongue portion extending in a generally upward direction includes a central region and edges arranged so the edges are farther from a plane defining a back face of the base than the central region, such that the upwardly extending tongue portion has a convex configuration with respect to the base. The convex configuration enables the tongue to have a higher bending modulus than a tongue having a straight cross section or a cross section such that the tongue edges are closer to the back face than a center region of the tongue, i.e., a concave configuration with respect to the base.

Another aspect of the invention relates to a hanger for an object adapted to be hung on a wall that comprises a base to be fixedly attached to the wall and a tongue extending from the base so that when the base plate is attached to the wall, the tongue extends away from the wall in a generally upward direction from a region of the base where an end of the tongue intersects the base. A segment of the tongue in close proximity to the intersection of the tongue and base is arranged to receive and hold a thin elongated support structure, such as a wire, attached to the object when the base is attached to the wall. The base includes a protrusion extending away from and beyond a front face of the base beneath the tongue. The protrusion has an upper portion substantially at the intersection so at least some of the end of the tongue intersecting the base abuts and bears on the upper portion of the protrusion.

Preferably, the substantial portions of the tongue having the convex configuration has a length more than 50 percent the length of the tongue to further increase the bending modulus and therefore provide greater tongue stiffness.

The tongue segment in close proximity to the base region preferably includes an arcuate surface for supporting the elongated support structure. The arcuate support surface is preferably a sector of a circle.

Vertical cross sections of the tongue segment including the support surface for the elongated structure are preferably arranged such that the support surface and an exterior bottom surface of the tongue opposite the support surface are sectors of coaxial circles having different radii. The support surface radius is greater than the opposite bottom surface radius and each of the surfaces has an arcuate extent of approximately 90 degrees. This arrangement also helps to increase the tongue bending modulus.

The surface of the tongue for receiving the thin elongated support structure preferably extends substantially horizontally when the base is attached to the wall. The horizontal extent of the receiving surface between a planar front face of the base and a generally vertically extending surface of the tongue facing the base is sufficient to form a ledge for receiving the thin elongated support structure, to minimize fraying of the thin elongated support structure, which is frequently a wire, but can be other structures, e.g., a U-shaped hook on a picture frame. Fraying is further minimized by arranging the ledge to have an arcuate shape such that a center portion of the ledge is higher than the edges of the ledge when the base is attached to the wall.

The base, ledge and tongue are preferably arranged such that all bends in the ledge and tongue in all vertical cross sections, when the base is attached to the wall, are directed away from the front face of the base. Such a construction enables the tongue to be easily stamped from the base and assists in (1) minimizing the likelihood of the tongue breaking and (2) facilitating insertion of the thin elongated support structure on the tongue.

An end portion of the tongue, including the tongue free end and therefore remote from the tongue end intersecting the base, preferably extends away from the base at a greater angle than the portion of the tongue to which it is connected, to further facilitate insertion of the thin elongated structure on the tongue.

To minimize manufacturing cost, the base, tongue and protrusion are preferably formed as one piece from stamped sheet metal.

The above and still further objects, features and advantages of the present invention will become apparent upon consideration of the following detailed description of a specific embodiment thereof, especially when taken in conjunction with the accompanying drawings.

DETAILED DESCRIPTION OF THE DRAWING

Figure 8:
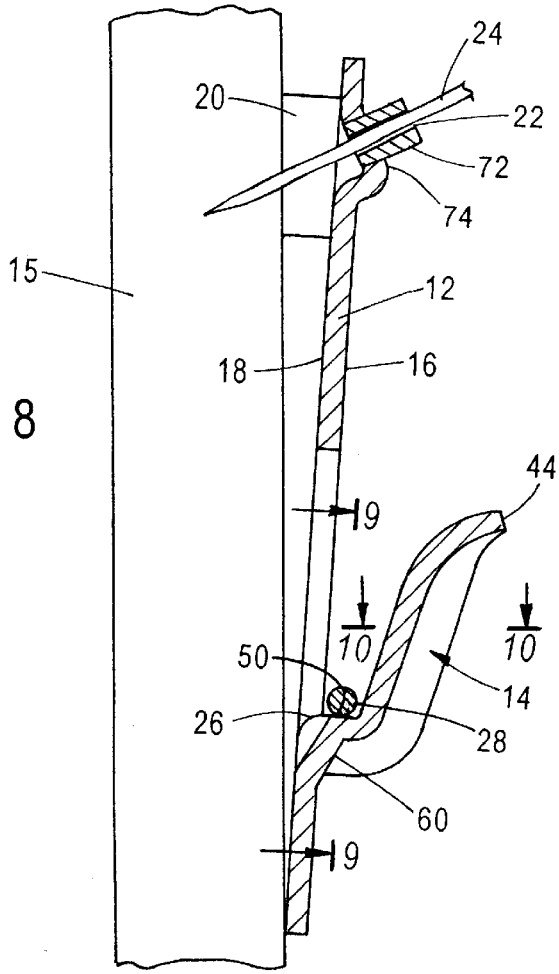
FIG. 8 is a side sectional view of a portion of the picture hanger of FIG. 1, as mounted on a wall, with a wire of a picture frame resting on a bite between a tongue of the hanger and the hanger base.

Reference is now made to the figures wherein a preferred embodiment of hanger 11 of the present invention is illustrated as including base 12 and tongue 14, which extends forwardly of the base, in an upward direction, when the hanger is mounted on fixed wall 15, e.g., a building wall, as illustrated in FIG. 8. While hanger 11 is described as a picture hanger, it is to be understood that the hanger can be used for other purposes. Base 12 includes planar front and back walls 16 and 18, wherein the back wall preferably carries shock absorbing structure 20 of a type disclosed in Weck et al., U.S. Pat. No. 6,095,465. Base 12 includes openings 22 for receiving nails 24, which extend through cushioning structure 20 into wall 15. Openings 22 are about 80 percent of the way above a horizontally extending center line of base 12 and the top edge of the base. Intersection 26 of base 12 and tongue 14 forms a bite for supporting wire 28, fixedly attached to a picture frame to be mounted on hanger 11. Preferably, hanger 11 is a one piece, stamped sheet metal structure, formed from cold rolled band steel having a thickness of approximately 1.5 millimeters, or U.S. gauge 16 (having a thickness of 0.060 inches), with tongue 14 being stamped from base 12.

Tongue 14 extends upwardly, along a vertically extending center line of base 12 when the hanger is attached to wall 15. (All references to directions, i.e., up, down, left and right side, in this detailed description of the drawing, assume that the hanger is hung on a wall in a position to receive wire 28. In addition, the terms front face, rear face, forward and rearward refer to the hanger as it is hung on wall 15, assuming that portions of the hanger which extend away from the wall are on the front face of the hanger and extend forwardly and vice versa for the rear face.) Intersection 26 between tongue 14 and base 12 is about two thirds of the way below the horizontally extending center line of the base and the bottom edge of the base. The relative positions of openings 22 and intersection 26 provide stability and assist in attaining maximum load handling characteristics of hanger 11.

Figure 10:
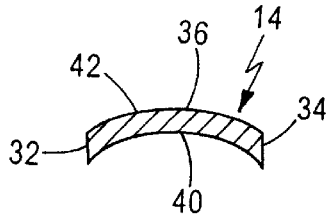
FIG. 10 is a horizontal sectional view of the tongue, taken through the lines 10—10 of FIG. 8.

Tongue 14 has an upwardly extending convex portion with respect to the plane of back face 18 of base 12. The convex portion, which includes upwardly extending edges 32 and 34 as well as upwardly extending central region 36, is more than 50 percent of the total length of the tongue. Edges 32 and 34 of tongue 14 are farther from planes defined by the front and rear faces 16 and 18 of base 12 than the tongue center region 36, to thus form the convex portion with respect to the base. In a horizontal cross section of the portion of tongue 14 including the convex portion, as illustrated in FIG. 10, rear surface 40 and forward surface 42 of the tongue have arcuate shapes defined by concentric circles having slightly different radii, such that the radius of rear tongue surface 40 is slightly less than the radius of front tongue surface 40. Preferably, each of arcuate surfaces 38 and 40 has an angular extent of approximately 90 degrees.

By forming tongue 14 so that it is convex with respect to base 12, there is an increase in the bending modulus of the tongue relative to a tongue that is straight with respect to the base or which is concave with respect to the base. Increasing the bending modulus of tongue 14, i.e., increasing the tongue stiffness, enables hanger 11 to hold objects having greater weight.

Figure 4:
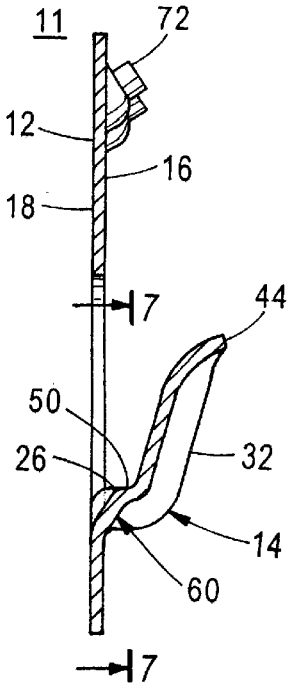
FIG. 4 is a side sectional view of the picture hanger illustrated in FIG. 1, taken through the lines 4—4.
Figure 5:
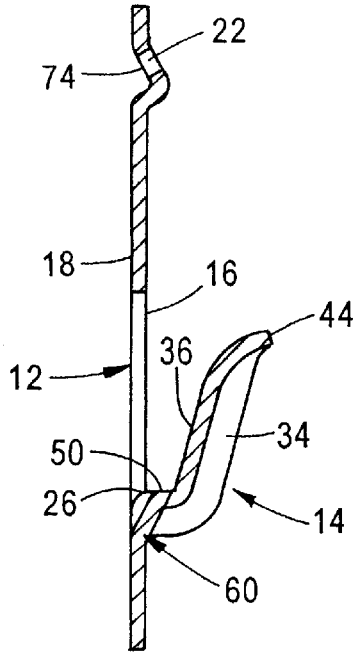
FIG. 5 is a side sectional view of the picture hanger illustrated in FIG. 1, taken through the lines 5—5.
Figure 6:
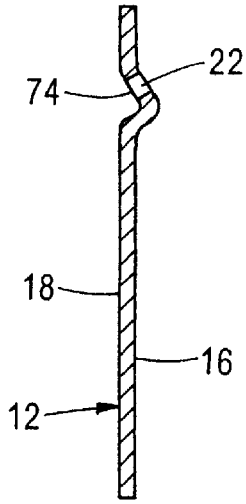
FIG. 6 is a side sectional view of the picture hanger illustrated in FIG. 1, taken through the lines 6—6.

As illustrated in FIG. 4, the portion of tongue 14, including arcuate surfaces 40 and 42, i.e., having the convex configuration, has a constant inclination angle with respect to front face 16 of base 12; the angle is preferably approximately 15 degrees. The tongue is convex from the vicinity of intersection 26 of the tongue with base 12 almost to the opposite, free end 44 of the tongue. The tongue portion including free end 44 tilts away from front face 16 of base 12 by a greater angle than the remainder of the tongue to facilitate placement of wire 28 on the hanger. In a preferred embodiment, free end 44 of tongue 14 is inclined at an angle of approximately 40 degrees with respect to the plane of front face 16 of base 12. There are smooth, rounded transitions between the tongue portions which extend at 15 degrees and 40 degrees relative to the plane of front face 16 and the tongue segments connected to them.

Wire 28 rests on a generally horizontally extending ledge 50, defined by the upper surface of tongue 14 in closest proximity to intersection 26 between the tongue and base 12. Ledge 50 extends forwardly and generally horizontally between front face 16 of base 12 and the upwardly directed portion of the tongue having the convex shape by a sufficient distance to accommodate the expected diameter of picture hanger wire 28. Such an extent prevents hanger wire 28 from being pinched between the upwardly directed portion of tongue 14 and base 12, to maintain the strength and integrity of the wire. In one preferred embodiment, particularly designed for holding picture frames having weights up to 50 pounds, ledge 50 protrudes forwardly of front edge 16 by 4 millimeters.

Figure 9:
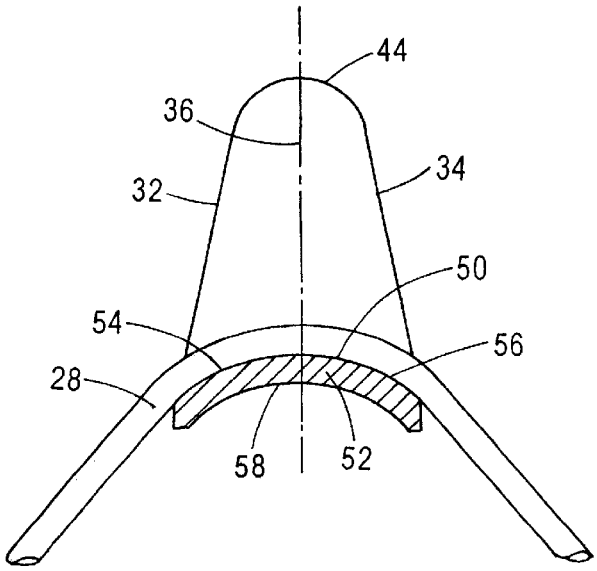
FIG. 9 is a side sectional view of the structure illustrated in FIG. 8, taken through the lines 9—9.

In the vertical plane, when hanger 11 is mounted on wall 15, ledge 50 has an arcuate shape (FIG. 9), with a center portion 52 and side portions 54 and 56, such that the center portion is above the side portions. Bottom surface 58 of tongue 14 opposite from ledge 50 also has an arcuate shape.

Ledge 50 and bottom surface 58 are preferably sectors of circles having a common center and slightly different radii, such that the radius defining ledge 50 is slightly larger than the radius defining bottom surface 58. Such a construction minimizes possible fraying and other damage to wire 28 and increases the load capability of hanger 11.

From the foregoing, all portions of tongue 14 bend away from front face 16 by progressively increasing angles, which never exceed 90 degrees. Such construction enables tooling for the stamping operation to be simplified, to provide a substantial economic advantage and reduces materially the likelihood of the tongue breaking.

Figure 1:
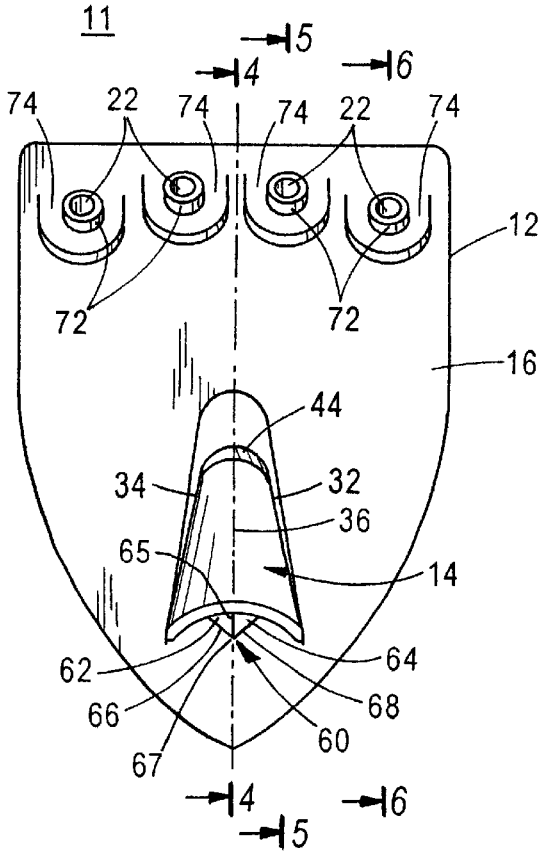
FIG. 1 is a front view of a picture hanger in accordance with a preferred embodiment of the invention.
Figure 2:
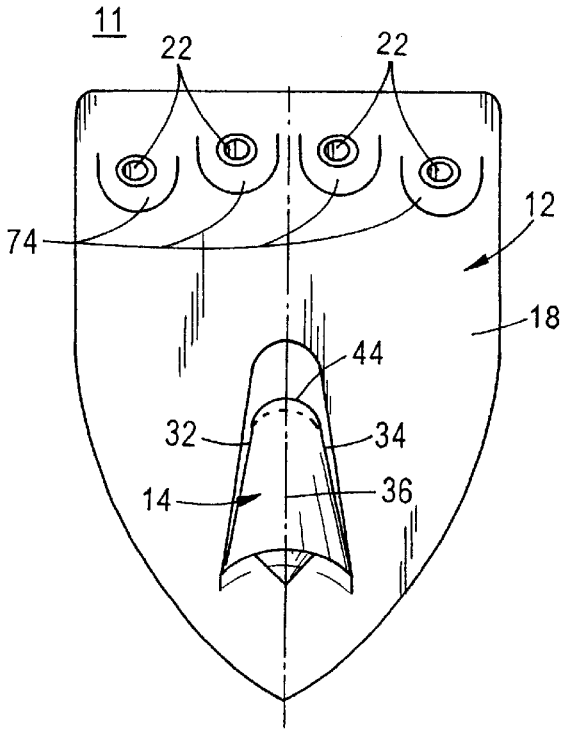
FIG. 2 is a back view of the picture hanger illustrated in FIG. 1.
Figure 3:
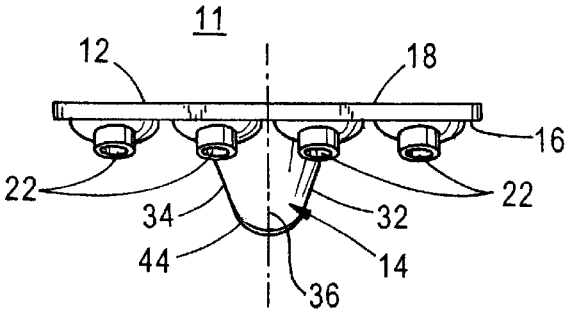
FIG. 3 is a top view of the picture-hanger illustrated in FIG. 1.
Figure 7:
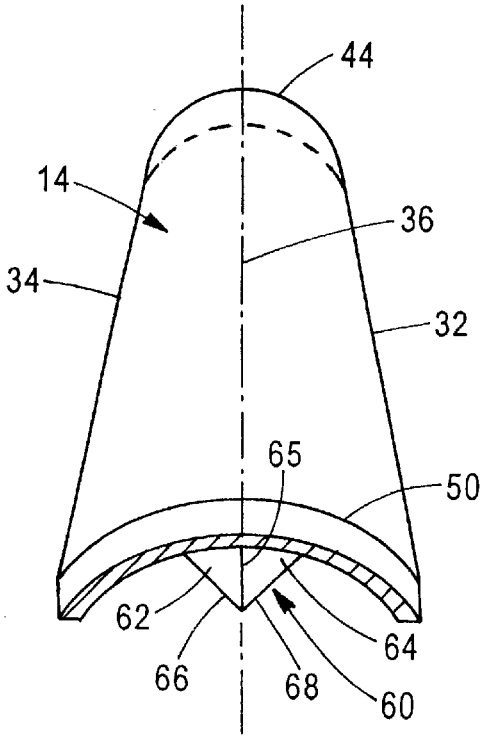
FIG. 7 is a side sectional view taken through the lines 7—7, FIG. 4.

As illustrated in FIGS. 1, 4 and 7, base 12 includes protrusion 60 that extends beyond front face 16 and includes planar, triangular shaped faces 62 and 64 that intersect at vertical straight center line 65, coincident with the vertically extending center line of tongue 14, so that the protrusion has the shape of a pyramid. Faces 62 and 64 respectively include sloping straight, equal length edges 66 and 68 that intersect each other and center line 65 at point 67. Edges 66 and 68 diverge from point 67 to form intersections between faces 62 and 64 and front face 16 of base 12. Faces 62 and 64 intersect each other along center line 65 at an angle of approximately 90 degrees. Faces 62 and 64 extend upwardly from back face 18 of base 12 by an angle of 45 degrees and extend beyond the front face 16 of base 12. The center portion of bottom surface 58 of tongue 14 opposite ledge 50 bears against the upper most portions of faces 62 and 64 of protrusion 60, which is formed by the same stamping operation as the stamping operation which forms tongue 14. From rear face 18 of base 12, protrusion 60 is similar to a dimple.

For a 50 pound hanger formed of 1.5 millimeter thick steel, protrusion 60 (1) extends 2.5 millimeters beyond front face 16 of base 12 and (2) has a length of 4 millimeters in the horizontal direction along its upper most portions against which bears the central part of the portion of tongue 14 opposite ledge 50. Thus, in a vertical cross section through the center of base 12, the horizontal extent of the upper most portion of protrusion 60 from back face 18 of base 12 to the most forward portion of the protrusion, where it intersects the center of bottom surface 58, is 4 millimeters, and the horizontal extent of the upper most portion of protrusion 60 along a line coincident with the plane of front face 16 and at right angles to center line 65 is 4 millimeters. The shape of protrusion 60 and its abutting load bearing relation which the bottom of tongue 14, beneath ledge 50, further increase the bending modulus of the tongue and therefore increase the holding capacity of the hanger, by providing added strength to ledge 50.

To mount hanger 11 on wall 15, the upper portion of hanger base 12 includes one or more circular openings 22, each of which is sized to receive a nail 24. The number of openings 22 depends on the carrying capacity of a particular hanger. For the hanger specifically illustrated, capable of hanging a picture frame or other object having a maximum weight of 50 pounds, four openings 22 are provided for receiving nails 24 having a 1.80 millimeter diameter. Openings 22 are arranged in pairs on opposite sides of the vertical center line of base 12, such that the two openings closest to the center line are equispaced from the center line and the two openings remote from the center line are equispaced from the center line. Each of openings 22 is formed in a bushing 72 that is riveted to the front face of base 12, in fairly close proximity to the upper edge of the base. The riveting is performed such that the back face 18 of base 12 has no rearwardly extending protrusions. To this end, back face 18 of base 12 includes dimples 74. Dimples 74 extend as concave surfaces beyond the front face of base 12 to which bushings 72 are riveted.

The stated construction of openings 22 and bushings 72 is highly advantageous because nails 24 do not push base 12 into wall 15 because of dimples 74. Bushings 72 guide the nails at a predetermined angle, equal to the angle of the axes of openings 22 and the bushings relative to the plane of face 16, to facilitate insertion of the nails and prevent them from prematurely falling out of holes 22. Pad 20 also assists in holding nails 24 in place prior to the nails being hammered into wall 15. The predetermined angle, preferably 45 degrees, of the axes of holes 22, resulting from the presence of bushings 72, assists in increasing the contact surface between wall 15 and nails 24 by increasing the penetration or embedding length of the nails into the wall. This structure helps to increase the load capability of the hanger compared to other hangers.

While there has been described and illustrated a specific embodiment of the invention, it will be clear that variations in the details of the embodiment specifically illustrated and described may be made without departing from the true spirit and scope of the invention as defined in the appended claims.

We claim:

1. A hanger for an object adapted to be hung on a wall comprising a base to be fixedly attached to the wall, a tongue extending from the base, the tongue being constructed so that when the base is attached to the wall, a substantial portion of the tongue extends in a generally upward direction from a region of the base where an end of the tongue intersects the base to form an intersection, a segment of the tongue in close proximity to the intersection being arranged to receive and hold a thin elongated support structure attached to the object when the base is attached to the wall, the tongue portion extending in a generally upward direction including a central region and edges, the edges of the tongue portion being farther from a plane defining a back face of the base than the central region, the base including a protrusion extending beyond a front face of the base beneath the tongue when the base is mounted on the wall, the protrusion having an upper portion, the upper portion of the protrusion being substantially at the intersection, at least some of the end of the tongue intersecting the base abutting and bearing on the protrusion upper portion.

2. The hanger of claim 1 wherein the protrusion is formed as a dimple extending away from the back face of the base.

3. The hanger of claim 1 wherein the base, tongue and protrusion are formed as one piece from stamped sheet metal.

4. The hanger of claim 3 wherein the substantial portion of the tongue is more than 50 percent the length of the tongue.

5. The hanger of claim 4 wherein horizontal cross sections of the substantial tongue portion when the base is mounted on the wall, have first and second surfaces that are sectors of coaxial circles having different radii, the first surface being closer to the back face than the second surface.

6. The hanger of claim 5 wherein each of the surfaces has an arcuate extent between the edges of the substantial portion of the tongue of approximately 90 degrees.

7. The hanger of claim 6 wherein the tongue segment has a surface for receiving the thin elongated support structure, said surface for receiving extending substantially horizontally when the base is mounted on the wall, the horizontal extent of the receiving surface between a planar front face of the base and a vertically extending surface of the tongue facing the base being sufficient to form a ledge for receiving the thin elongated support structure.

8. The hanger of claim 7 wherein the ledge has an arcuate shape such that a center portion of the ledge is higher than the edges of the ledge when the base is mounted on the wall.

9. The hanger of claim 8 wherein the arcuately shaped ledge and the end of the tongue at the intersection have the same length at the intersection in the horizontal direction when the hanger mounted on the wall.

10. The hanger of claim 9 wherein the base, tongue and protrusion are formed as one piece from stamped sheet metal.

11. The hanger of claim 8 wherein the base, ledge and tongue are arranged such that all bends in the ledge and tongue in all vertical cross sections, when the base is attached to the wall, are directed away from the front face of the base.

12. The hanger of claim 11 wherein the tongue has an end portion, including a free end, remote from its end intersecting the base, the tongue end portion including the free end extending away from the base at a greater angle than the portion of the tongue to which it is connected.

13. The hanger of claim 12 wherein the portion of the tongue extending away from the base in a generally upward direction including the edges and the central region slants away from a plane including a front face of the base at a substantially constant angle.

14. The hanger of claim 13 wherein the protrusion is formed as a dimple extending away from the back face of the base.

15. A hanger for an object adapted to be hung on a wall comprising a base to be fixedly attached to the wall, a tongue extending from the base, the tongue being constructed so that when the base is mounted on the wall, a substantial portion of the tongue extends in a generally upward direction from a region of the base where an end of the tongue intersects the base to form an intersection, a segment of the tongue, in close proximity to the intersection being arranged to receive and hold a thin elongated support structure attached to the object when the base is attached to the wall, the base including a protrusion extending beyond a front face of the base beneath the tongue, the protrusion having an upper portion, when the base is mounted on the wall, the upper portion of the protrusion being substantially at the intersection, at least some of the end of the tongue intersecting the base abutting and bearing on the upper portion of the protrusion, the protrusion being formed as a dimple extending away from the back face.

16. The hanger of claim 15 wherein the tongue segment in close proximity to the intersection includes an arcuate surface for supporting the thin elongated support structure when the base is mounted on the wall.

17. A hanger for an object adapted to be hung on a wall comprising a base to be fixedly attached to the wall, a tongue extending from the base, the tongue being constructed so that when the base is mounted on the wall, a substantial portion of the tongue extends in a generally upward direction from a region of the base where an end of the tongue intersects the base to form an intersection, a segment of the tongue in close proximity to the intersection being arranged to receive and hold a thin elongated support structure attached to the object when the base is attached to the wall, the base including a protrusion extending beyond a front face of the base beneath the tongue, the protrusion having an upper portion, when the base is mounted on the wall, the upper portion of the protrusion being substantially at the intersection, at least some of the end of the tongue intersecting the base abutting and bearing on the upper portion of the protrusion, the tongue segment in close proximity to the intersection including an arcuate surface for supporting the thin elongated support structure when the base is mounted on the wall.

18. The hanger of claim 17 wherein the arcuate surface extends away from the base.

19. The hanger of claim 17 wherein the tongue segment has a surface for receiving the thin elongated support structure, said surface for receiving the thin elongated support structure extending away from the base when the base is attached to the wall, the horizontal extent of the receiving surface between a planar front face of the base and a vertically extending surface of the tongue facing the base being sufficient to form a ledge for receiving the thin elongated support surface.

20. The hanger of claim 17 wherein the arcuate surface and the end of the tongue at the intersection have the same length at the intersection in the horizontal direction when the hanger is mounted on the wall.

21. The hanger of claim 20 wherein the base, tongue and protrusion are formed as one piece from stamped sheet metal.

22. The hanger of claim 17 wherein the arcuate support surface is a sector of a circle.

23. The hanger of claim 22 wherein the support surface has an arcuate extent of approximately 90 degrees.

24. The hanger of claim 22 wherein vertical cross sections of the tongue segment including the support surface have a lower exterior surface opposite to the support surface when the base is attached to the wall, the sections of the tongue having the support and lower exterior surfaces being sectors of coaxial circles having different radii, the support surface radius being greater than the lower exterior surface radius.

25. The hanger of claim 24 wherein each of the surfaces has an arcuate extent of approximately 90 degrees.

26. A hanger for an object adapted to be hung on a wall comprising a base to be fixedly attached to the wall, at tongue extending from the base, the tongue being constructed so that when the base is mounted on the wall, a substantial portion of the tongue extends in a generally upward direction from a region of the base where an end of the tongue intersects the base to form an intersection, a segment of the tongue in close proximity to the intersection being arranged to receive and hold a thin elongated support structure attached to the object when the base is attached to the wall, the base including a protrusion extending beyond a front face of the base beneath the tongue, the protrusion having an upper portion, when the base is mounted on the wall, the upper portion of the protrusion being substantially at the intersection, at least some of the end of the tongue intersecting the base abutting and bearing on the upper portion of the protrusion, the tongue segment having a surface for receiving the thin elongated support structure, said surface for receiving the thin elongated support structure extending substantially horizontally when the base is attached to the wall, the horizontal extent of the receiving surface between a planar front face of the base and a vertically extending surface of the tongue facing the base being sufficient to form a ledge for receiving the thin elongated support surface, the ledge having an arcuate shape such that a center portion of the ledge is higher than the edges of the ledge when the base is attached to the wall.

27. The hanger of claim 26 wherein the base, ledge and tongue are arranged such that all bends in the ledge and tongue in all vertical cross sections, when the base is attached to the wall, are directed away from the front face of the base.

28. The hanger of claim 26 wherein the base, ledge and tongue are arranged such that all bends in the ledge and tongue in all vertical cross sections, when the base is attached to the wall, are directed away from the front face of the base and are less thin 90 degrees.

29. The hanger of claim 26 wherein the tongue has an end portion, including a free end, remote from its end intersecting the base, the end portion including the free end extending away from the base at a greater angle than the portion of the tongue to which it is connected.

30. The hanger of claim 26 wherein the base, tongue and protrusion are formed as one piece from stamped sheet metal.

* * * * *